United States Patent [19]

Byrt

[11] Patent Number: 4,508,333

[45] Date of Patent: Apr. 2, 1985

[54] SHEET STACKING APPARATUS

[76] Inventor: Graham A. B. Byrt, Thrissell Works, Easton Rd., Bristol BS5 0HE, England

[21] Appl. No.: 426,521

[22] Filed: Sep. 29, 1982

Related U.S. Application Data

[63] Continuation of Ser. No. 237,162, Feb. 13, 1981.

[30] Foreign Application Priority Data

Jun. 13, 1979 [GB] United Kingdom ..... 7920581
Jun. 13, 1980 [GB] United Kingdom ... PCT/GB80/102

[51] Int. Cl.[3] ..... B65H 29/34

[52] U.S. Cl. ..... 271/218; 271/189; 414/54

[58] Field of Search ..... 414/54; 271/189, 190, 271/192, 217, 218

[56] References Cited

U.S. PATENT DOCUMENTS 2,918,852 12/1959 Buccicone ..... 414/54 X
3,860,127 1/1975 Fassman ..... 414/54
4,157,059 6/1979 Schultes ..... 414/54 X

FOREIGN PATENT DOCUMENTS 2328659 2/1975 Fed. Rep. of Germany .

*Primary Examiner*—Richard A. Schacher
*Attorney, Agent, or Firm*—Seidel, Gonda & Goldhammer

[57] ABSTRACT

A method is disclosed for forming a stack of sheets from a succession of sheets, in which the stack is formed of portions each containing the desired number of sheets and the portions are displaced horizontally in the stack in relation to adjacent portions to facilitate later handling and processing of the portions. Alternate portions of the stack may be in vertical alignment or the horizontal displacement may be only in one direction so that the stack simulates a flight of steps. The displacement may be produced by supporting the top part of the stack and displacing the part of the stack below the support, the operation being repeated each time the support moves up one portion, or by forming each portion at a position displaced from the portion below it.

7 Claims, 8 Drawing Figures

SHEET STACKING APPARATUS

Figure 1:
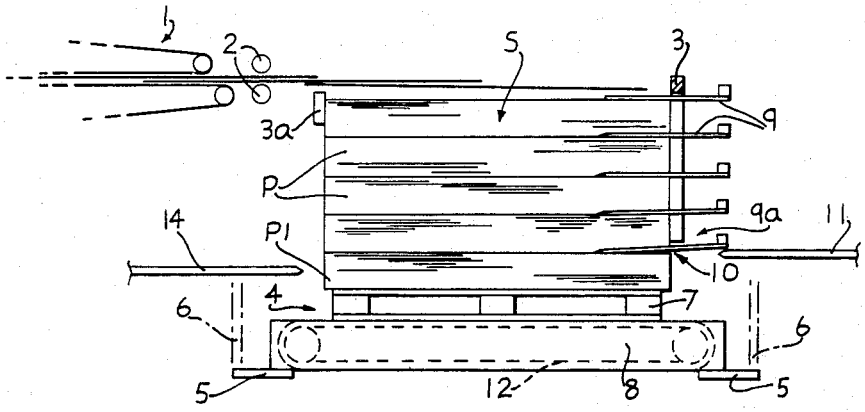

This is a continuation of application Ser. No. 237,162, filed Feb. 13, 1981, pending.

This invention concerns improvements in or relating to a method for forming a stack from a succession of sheets of, for example, paper.

It is usual for sheets to be formed into large stacks either by a delivery unit which is raised in unison with the growing stack or more usually the sheets are collected on a platform or table which descends at the growing rate of the stack. These stacks are often required to be separated into smaller batches (e.g. a ream of 500 sheets) for feeding to machines for carrying out further operations such as wrapping the reams in an outer wrapper.

The individual batches contained in a stack are commonly marked by inserting paper tabs at appropriate positions. These stacks are then separated into the required batches manually, which is rather time consuming. A disadvantage of the tab system is that the tabs can become disturbed and the benefit of marking the batches is lost. Where other more substantial devices are used to mark the stack e.g. angle strips, then these must be moved around the factory either manually or automatically.

It is also known to divide a stack as it is being formed into batches and remove the lowermost batch, whilst the rest of the stack is being supported by an auxiliary support, for feeding to apparatus for carrying out further operations on each batch.

According to the present invention there is provided a method for forming a stack from a succession of sheets, said stack consisting of at least two portions each containing a desired number of sheets, including support means on which said stack is formed, means for feeding said sheets in succession onto said support means, at least one of said feeding means and said support means being movable to alter the relative positions of said feeding means and said support means, and means for moving at least one of said feeding means and said support means at intervals corresponding to the times taken to form successive portions of said stack, so that at least two edges of each portion of said stack are displaced from alignment with the corresponding edges of an adjacent portion.

In one form the apparatus further includes divider means for dividing the stack as it is formed into said portions, auxiliary support means which moves between an operative support position and an inoperative position clear of the stack, means for operating said divider means to create an opening between successive portions of said stack to enable said auxiliary support means to enter the stack at said opening, and means for moving the part of said stack below said auxiliary support means, when the latter is in its operative position, so that at least two of the edges of said part adjacent said one side are displaced from alignment with the corresponding edges of the part of said stack positioned above said auxiliary support means.

Conveniently the support means may be mounted on wheels so that after each movement of said auxiliary support means to its operative support position the support means may be moved by any suitable means a distance equal to the distance by which it is desired that successive portions of said stack are to be displaced relative to each other.

Alternatively the support means may be provided with conveyor bands which may be driven at the appropriate times to move the stacks supported thereon the desired distance.

In another form of apparatus the required displacement of each successive portion of said stack may be obtained by moving the delivery means the required distance relative to the support means, after each time that a desired number of sheets to form a portion of the stack have been fed to said support means.

Another type of machine produces, instead of stacks, individual packs or reams at one or more delivery units. These are ideal if the next process is directly coupled to the stacking machine. There can, however, be problems is either the machine producing the stacks or any machine for carrying out further operations gives trouble. Inevitably the whole system must be stopped to clear the problem with a consequent loss of production. It is therefore desirable to provide a buffer store between the stacking machine and the next process which can accommodate the fluctuations of input and output speed of the system elements.

The stack formed on apparatus according to the present invention consists of a number of portions, with at least two edges of each portion out of alignment with the corresponding edges of adjacent portions. Such a stack may conveniently be used to provide a buffer store between successive machines carrying out different operations. The displacing of one portion of a stack from an adjacent portion provides a suitable step for guiding a separating member so that the latter may be easily inserted into the stack to separate a portion therefrom, the separating position then being conveyed away so that the next operation may be carried out.

In the formation of stacks according to the present invention the successive portions may be moved alternately in opposite directions so that the alternate portions of the stack are in alignment with each other and the adjacent portions are out of alignment. Alternatively, the movements of the successive portions may all be in the same direction so that the corresponding edges of the portions of the stack resemble a flight of steps.

Figure 2:
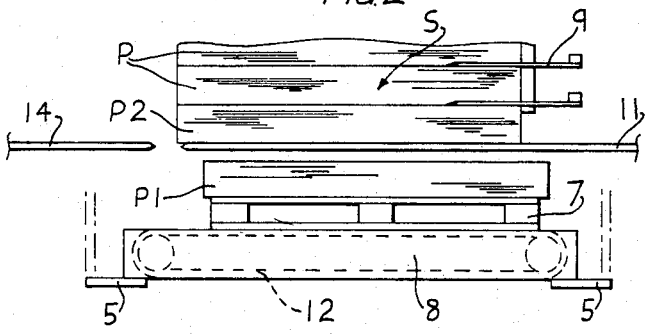
Figure 3:
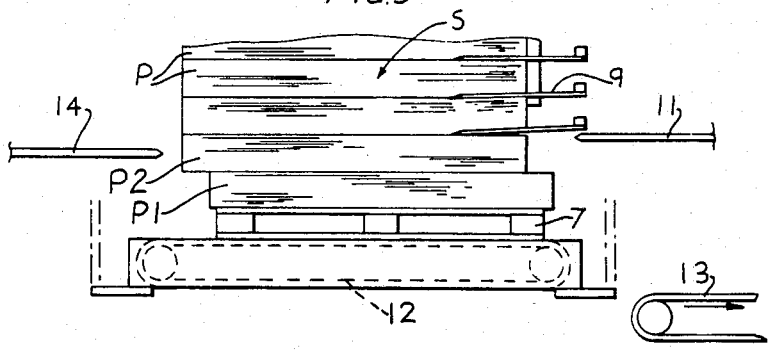
Figure 4:
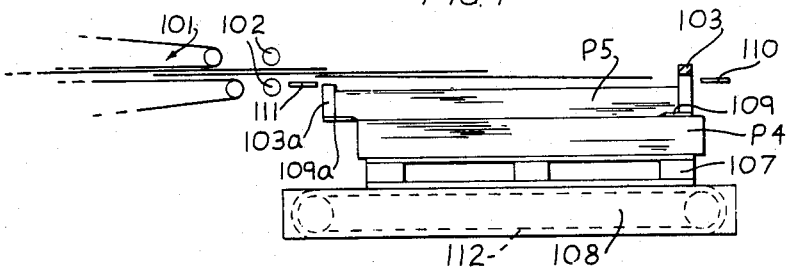
Figure 5:
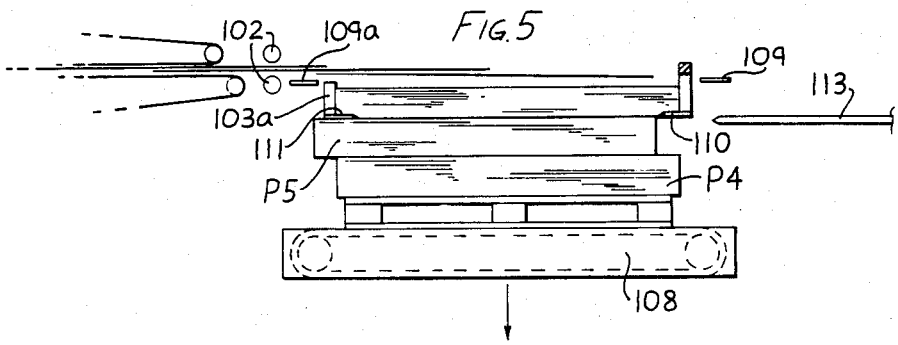
Figure 6:
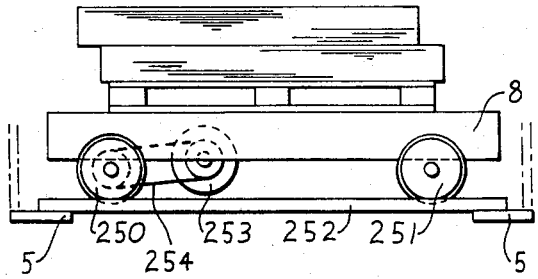
Figure 7:
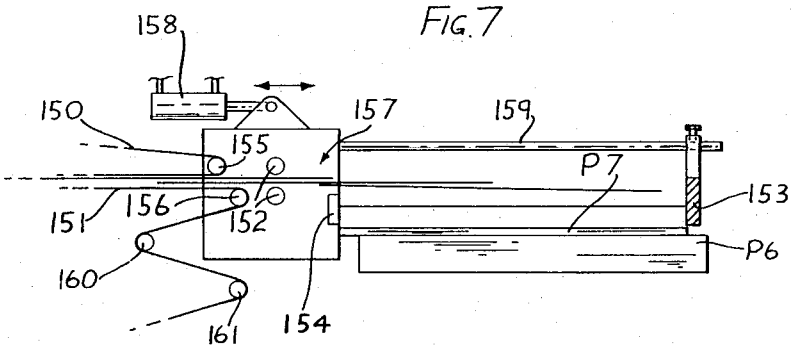
Figure 8:
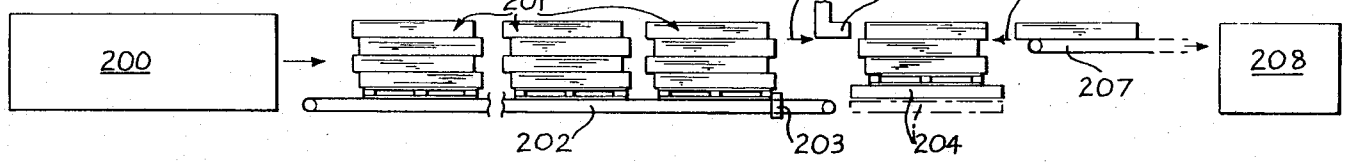

The invention will now be described by way of example only with reference to the accompanying drawings in which:

FIG. 1 is a diagrammatic side view of one form of stack forming apparatus according to the invention, FIGS. 2 and 3 are views similar to FIG. 1 showing some of the parts of that figure at later stages in the forming of a stack, FIG. 4 is a diagrammatic side view of a modified form of the apparatus of FIG. 1, FIG. 5 is a view similar to FIG. 4 but showing a later stage in the forming of a stack, FIG. 6 is a diagrammatic side view of a modified form of stack supporting table for use in the above apparatus, FIG. 7 is a diagrammatic side view of an alternative form of stack forming apparatus, and FIG. 8 illustrates stacks formed according to the present invention being used as a buffer store between successive machines.

Referring to FIG. 1, a stream of overlapped sheets is fed to the right by a pair of belt conveyors 1 between a pair of cooperating rollers 2 and, on leaving the nip of these rollers, each sheet travels further to the right above a stack S, in the course of formation, until it strikes a backboard 3, whereupon the sheet falls on top of the stack. The left hand edge of the stack is kept in alignment by known vibrating plates 3*a*. The stack is formed on a support platform 4, which is carried on lugs 5 attached to chains 6 which are used to raise and lower the platform 4 in the usual way. The platform 4 comprises a pallet 7 supported on a table 8. During stack formation the platform 4 is lowered a short distance at a time, under the control of a stack height sensor (not shown) of any convenient type so that the top of the stack S is maintained at optimum spacing below the path of the sheets from rollers 2 to the backboard 3.

As the stack is being formed a divider 9 is inserted into the stack each time a desired number of sheets have been fed onto the top thereof so that the stack is divided into a number of portions P. The dividers 9 are moved in a closed path, one part of which serves as a magazine (not shown) from which a divider is removed each time one is required to be inserted into the stack. The continuing downward movement of the stack carries the dividers 9 in a downward direction with it. As a divider 9 reaches the position indicated at 9*a* further downward movement of the divider is prevented, but the stack however continues its downward movement which creates a wedge-shaped gap in the side of the stack, as shown at 10. An auxiliary support 11 is moved from an inoperative position shown in FIG. 1, into the gap 10 to an operative position in which it completely divides the stack as shown in FIG. 2. As the auxiliary support member 11 is being inserted into the stack, the divider 9 is withdrawn therefrom and returned to the magazine. The apparatus so far disclosed is similar to and operates in the same manner as that described in British Patent Specification No. 1,533,871. The support 11 then moves downwards with the stack and the platform 4 is lowered at a slightly higher speed to create a gap between the portion P1 of the stack supported on the pallet 7 and the underside of the support 11 (FIG. 2). The pallet 7, carrying the portion P1 is moved to the right a desired distance (FIG. 2) by means of a conveyor band 12 mounted in the table 8 and driven by a motor (not shown). The platform 4 is then raised again until the top of portion P1 is just below the auxiliary support 11 which is then withdrawn so that the whole of the stack is again supported on the platform 4. The support 11 is then raised to its starting position ready to be inserted into the stack again, at position 9*a*. The movement of platform 4 is now reversed so that once again the platform descends at the growth rate of the stack until the next divider 9 reaches the position 9*a* and the above cycle of operations is repeated. However, because the portion P1 has been moved to the right, as mentioned above, its edges are no longer in vertical alignment with the edges of the portions above it in the stack S.

After the next portion P2 has been separated from the part of the stack above it, as described above in relation to the portion P1, and in the manner shown in FIGS. 2 and 3, the pallet 7, carrying the portions P1 and P2 is moved to the left by the conveyor band 12, by the same distance as it was previously moved to the right. The platform 4 is again raised and the auxiliary support 11 withdrawn. Due to the movement of the pallet 7 to the left, the edges of the portion P2 are out of vertical alignment with those of the portions above it, but the latter are aligned with corresponding edges of the portion P1.

As successive portions of the stack S are moved alternately to the right and left after being separated, as described above, by the auxiliary support 11, a number of portions, each of which is displaced, relative to the next adjacent portions, are built up on the pallet 7.

When a desired number of portions have been collected on the pallet 7 and the auxiliary support 11 is in its operative position (as in FIG. 2) the platform 4 is lowered until the pallet is level with a take-off conveyor 13 (shown in FIG. 3). The conveyor 12 is then operated to transfer the loaded pallet 7 from the table 8 onto the conveyor 13 which in turn carries the pallet towards another machine for carrying out further operations. An empty pallet is placed in position on the conveyor 12 and the platform 4 is raised so that the pallet is just below the auxiliary support 11 which is then withdrawn, and the operations described above are repeated to form a fresh stack on the platform 4.

A secondary support 14 is provided to be used in cases in which the time taken to remove a loaded pallet from the apparatus and replace it with an empty one, as described above, is greater than the time between successive operations of the auxiliary support 11. This secondary support 14 is controlled by mechanism not shown and is inserted into the stack from the opposite side and in alignment with the auxiliary support 11 simultaneously and progressively with the withdrawal of the support 11 so that support of the stack is progressively transferred from the auxiliary support 11 to the secondary support 14, the latter also moving downwards at the growth rate of the stack. After the auxiliary support 11 has been withdrawn from the stack it again rises to its starting position for reinsertion at position 9*a*.

If the pallet changing cycle time is such that the new pallet is raised by the table 4 to a position just below the secondary support 14 before or soon after the auxiliary support is again inserted into the stack, the secondary support is withdrawn, so that the stack is again supported on the table 4, the secondary support then being raised to its starting position. A fresh stack is then formed on the table 4 and when that stack is completed the above sequence of operations is repeated.

If the pallet changing cycle time is longer then the secondary support 14 remains in position. The support 14 carrying a single portion, is lowered at a slightly higher speed to create a gap between this portion and the auxiliary support 11, and is then moved to the left or right so that the portion carried thereby is out of alignment with the adjacent portion above. The secondary support 14 is then raised again until the portion it supports is just below the auxiliary support 11 which is then withdrawn and raised back to its starting position. The support 14, now carrying two portions, is now lowered again at the stack growth rate. If a new pallet has not been fed to the apparatus when the auxiliary support has been again inserted the secondary support is moved to the left or the right, as the case may be, so that the bottom portion on the support 14 comes back into alignment with the portion next above the auxiliary support 11, the portion resting on the bottom portion on the support having been moved out of alignment with the portion next above the auxiliary support 11. The auxiliary support 11 then retracts again from the stack. This cycle of operations continues until a new pallet is raised to a position just below the secondary support 14 which is then withdrawn and raised to its starting position. The formation of the stack then continues on the pallet, and when it is completed the stack is removed, as described above.

If desired the stack may be formed completely on the secondary support 14, the table 4 being utilised only when the stack is completed. In this case, after the auxiliary support 11 has been inserted above the top portion of a desired number of portions forming the stack, the secondary support 14 is lowered to a pallet on the table 4 and is withdrawn, so that the stack is transferred to the table 4. The secondary support 14 is now raised to the level of the auxiliary support 11 and inserted beneath the stack to support the latter as the auxiliary support 11 is simultaneously withdrawn. The secondary support 14 then descends at the stack growth rate and a new stack is formed on it as described above.

In an alternative form of apparatus, shown in FIG. 7, sheets are fed by conveyors 150, 151 and rollers 152 (which correspond respectively to conveyors 1 and rollers 2) up to a backboard 153 whereupon they fall on top of a stack being formed below in the same way as described above, the left hand edge of the stack being kept in alignment by vibrating plates 154. The stack is supported on a pallet which, in turn, rests on a table, such as table 8 described above with reference to FIGS. 1 to 3.

The downstream ends of conveyors 150, 151 pass round rollers 155, 156 respectively which, together with rollers 152 and plates 154, are carried by a delivery head 157. The head 157 is movable in a horizontal plane by operation of a pneumatic cylinder 158. The backboard 153 is also carried by the delivery head 157 by means of a rod 159. The backboard 153 is movable along the rod 159 to vary its distance from the plate 154, which distance is determined by the length of the sheets being fed onto the stack. The lower run of conveyor 151 passes round two guide rollers 160, 161, the roller 160 being adjustable horizontally to maintain a desired tension in the conveyor 151 on movement of the delivery head 157.

In operation, the delivery head 157 is moved to a predetermined position and sheets are fed onto a pallet to form a stack. When a desired number of sheets have been fed to form a portion P6 of the stack, the delivery head 157, and thus the backboard 153 and plate 154, is moved to the left so that the edges of the next portion P7 of the stack are out of vertical alignment with the edges of the portion P6 below it.

When portion P7 is completed the delivery head 157 and the backboard 153 are returned to the right to the positions they occupied for the formation of portion P6 and the next portion is formed vertically aligned with portion P6 but out of vertical alignment with portion P7. These operations are repeated so that on formation of each successive portion the head 157 and backboard 153 are moved to the right or the left, as the case may be, so that a stack is formed in which the portions are arranged in a stepped formation, alternate portions being vertically aligned with each other. When a stack containing a desired number of portions has been formed, the stack is separated from the next portion above it by means of an auxiliary support (not shown). The support may be similar to the support 11 and be operated from the same side of the stack thereof. The separation of the completed stack from the next portion above it is effected by inserting the auxiliary support between the underside of that end of a portion which protrudes beyond the end of the portion next below and the top of the latter portion. In this case a divider is not required to form a gap in the side of the stack, as described above, before the support is inserted. A wedge-shaped gap is created by the leading end of the auxiliary support when it is below the protruding end of the portion above, due to the continuing downward movement of the stack, the auxiliary support at this time not being moved downwards. As soon as the leading end of the auxiliary support has entered between adjacent portions, the auxiliary support then starts to move downwards with the stack and separation is completed. To assist insertion of the auxiliary support into the stack, the support may be provided with apertures through which pressure air is fed to form a layer of air on its surfaces. The auxiliary support may, if desired be inserted from the opposite side of the stack (i.e. from the same direction as the secondary support 14). The stack is then removed from the apparatus in the same manner as described above with reference to FIGS. 1 to 3.

In a modified form of apparatus shown in FIGS. 4 and 5 sheets are fed by conveyors 101 and rollers 102 up to a backboard 103, the sheets then falling onto a stack being formed on a pallet 107 carried on a table 108. Table 108 is raised and lowered in the same manner as the table 8. A vibrating plate **103*a* is provided to align the falling sheets. With one portion P4 on the pallet 107, the first sheet of the next portion P5 falls onto retractable fingers 109, 109*a* positioned respectively immediately below the backboard 103 and plate 103*a*. When the desired number of sheets have been fed by the rollers 102 a further pair of fingers 110, 111 are inserted from opposite sides of the stack so that the first sheet of the next following portion to be formed falls onto the fingers 110, 111**.

Before the fingers 110, 111 are inserted the pallet 107 is moved to the right, as shown in FIG. 4, by a conveyor band 112 mounted in the table 108, so that the portion P4 is displaced from vertical alignment with the portion P5 being formed above it. After completion of the portion P5 the fingers 109, **109*a* are withdrawn but before this withdrawal occurs the fingers 110, 111 are inserted and the downward movement of the table 108 continues together with the fingers 110, 111. The fingers 109, 109*a*** are moved upwards and then inserted into the stack again so as to receive the first sheet of the next portion to be formed.

To allow time for the pallet 107 and its complement of portions to be removed, as described above in relation to the pallet 7, so as to be fed to a further machine, a support 113 (FIG. 5) may be provided to support the portions above it in the same manner as that described above in relation to the secondary support 14 (FIG. 1).

In a modified form of stack supporting table shown in FIG. 6, instead of the conveyor 12 being provided to move the portions as described above, the table 8 is fitted with pairs of wheels 250, 251 which run on rails 252, the wheels 250 being driven in the required direction at the desired times by a mtor 253 mounted on the table and drivingly connected to the wheels 250 by a chain 254. In this case the rails 252 are mounted on the lugs 5 to provide the necessary vertical movement of the table 8.

Instead of moving portions of the stack alternately in opposite directions, so that alternate portions of the stack are in alignment although adjacent portions are out of alignment, each successive displacement may be in the same direction so that edges of successive portions of the stack are disposed so as to resemble a flight of stairs. Moreover, whichever configuration of stack is formed, the apparatus may be arranged to produce the displacement between successive portions at right-angles to the direction of feed of the overlapped sheets onto the stack, instead of parallel to said direction as described above, or indeed the displacement may be such as to have components parallel to and at right-angles to said feed direction so that all edges of each stack portion are out of alignment with corresponding edges of each adjacent portion.

Referring now to FIG. 8, a machine 200 forms stacks 201, in a manner according to the present invention, which are transferred to a conveyor 202, the latter being continuously driven so that the stacks are fed to the right until the pallet supporting leading stack engages a stop 203, the conveyor 202 slipping under the stationary stacks. At certain times the stop 203 is withdrawn for a sufficient time to allow the leading stack to be fed onto a vertically-movable table 204 when the latter is in the position shown in chain-dot lines. The top portion of the stack on table 204 is removed therefrom by a pusher 205, the portion to be removed being first separated from the stack by fingers which are inserted into the stack at positions indicated by the arrows 206. The pusher 205 transfers the separated portion onto a further conveyor 207 which feeds it to a further machine 208 for carrying out further operations such as enclosing the portion in an outer wrapper. The table 204 is then raised by the height of one portion as shown in the Figure in solid lines and the next portion removed from the stack by the pusher 205. When all the portions have been removed from the table 204 the latter is lowered to the chain-dot position, and the stop 203 is withdrawn for a sufficient time to permit the next of the stacks 201 to be fed onto the table 204 by the conveyor 202.

The stacks on the conveyor 202 provide a buffer store between the machine 200 and the conveyor 207, so that if the machine downstream of the conveyor 207 stops, stacks being produced by machine 200 can be accommodated on the conveyor 202 and, conversely, if the machine 200 stops there are still stacks available on the conveyor 202 to be fed to the conveyor 207.

In the apparatus described above the stacking machine comprises only one stack forming device. However stacks may be formed alternately in two such devices provided in tandem, the stream of overlapped sheets being diverted to the second stacking device whilst a previously formed portion is being moved out of alignment with the portion below it in the first stacking device.

In all the constructions described above the pallet on which the stack is formed may be dispensed with and the stack formed directly on the respective table. In such instances air float tablets and conveyors, of any convenient type may be used to enable the stacks to be handled more easily.

I claim:

1. A method of feeding sheets to form a stack having a plurality of uniform portions each portion staggered with respect to adjacent portion comprising the steps of:

a. continuously feeding sheets generally horizontally in succession to a location wherein they are arrested and form a first portion of a stack with aligned edges, b. continuing the feeding of sheets to form a second portion above the first portion while displacing the first portion vertically so that it is separated from the second portion, c. moving the first portion after it has been displaced, then recombining the first and second portions so that the first portion is staggered with respect to the second portion, d. continuing the feeding of sheets to form a third portion above the second portion while displacing the first and second portions vertically so that they are separated from the third portion, moving the first and second portions as a unit after they have been displaced, then recombining the first and second portions with the third portion so that the second portion is staggered with respect to each of the first and third portions.

2. A method in accordance with claim 1 including providing a temporary support for the second portion during step (c) and for the third portion during step (d).

3. A method in accordance with claim 1 wherein the movement of the portions referred to in steps c and d include movement in the direction of feed and in an opposite direction.

4. A method in accordance with claim 3 wherein said steps of moving portions includes supporting the portions to be moved on an endless conveyor, and moving the endless conveyor to attain the displacement.

5. A method of feeding sheets to form a stack having a plurality of uniform portions each of which is staggered with respect to an adjacent portion comprising the steps of:

(a) providing a feed head and backboard means spaced apart and coupled for reciprocatory movement as a unit in a direction corresponding to the direction of feed and in an opposite direction, (b) continuously feeding sheets in succession from the head to the backboard means which arrests the sheets and forms a first portion of a stack with aligned edges, (c) continuing the feeding of sheets to said backboard means to form a second portion above the first portion, moving the head and backboard means in one of said directions so that the leading and trailing edges of the first and second portions are staggered with respect to each other, (d) continuing the feeding of sheets to said backboard means to accumulate a third portion above the second portion, moving the head and backboard means relative to the first and second portions in one of said of directions so as to stagger the third portion relative to the second portion, (e) moving accumulated portions downwardly with respect to said head and backboard means.

6. A method in accordance with claim 5 including inserting a divider between the last sheet of each portion and the first sheet of the portion thereabove.

7. A method in accordance with claim 6 wherein step e includes moving the divider downwardly with the accumulated portions.

* * * * *